US005186672A

United States Patent [19]

Tung

[11] Patent Number: 5,186,672

[45] Date of Patent: Feb. 16, 1993

[54] MULTIPURPOSE BLOCK TOY

[76] Inventor: Chen C. Tung, No. 15, Lane 63, Sec. 7, Yen Fing N. Rd., Taipei, Taiwan

[21] Appl. No.: 802,095

[22] Filed: Dec. 4, 1991

[51] Int. Cl.[5] ..... A63H 33/04

[52] U.S. Cl. ..... 446/95; 446/85; 446/108

[58] Field of Search ..... 446/85, 93, 94, 95, 446/97, 102, 104, 105, 106, 107, 108, 116, 117, 120, 122, 125, 489

[56] References Cited

U.S. PATENT DOCUMENTS

| | | | |
|---|---|---|---|
| 1,898,279 | 2/1933 | Fox | 446/105 X |
| 2,649,803 | 8/1953 | Andre | 446/104 |
| 3,510,979 | 5/1970 | Fischer | 446/102 |
| 3,955,814 | 5/1976 | Shallenberger | 446/85 X |
| 4,642,063 | 2/1987 | Gillete | 446/94 |
| 4,678,192 | 7/1987 | Campbell | 446/97 X |

*Primary Examiner*—Robert A. Hafer
*Assistant Examiner*—Sam Rimell
*Attorney, Agent, or Firm*—Lowe, Price, LeBlanc & Becker

[57] ABSTRACT

A multipurpose block toy comprised of a set of blocks, a set of connecting rods and a set of rollers, wherein said blocks can be separately used in playing the game of domino effect or the game of teaching and learning; said blocks, said connecting rods and said rollers can be simultaneously used in playing the game of building and the game of domino effect.

3 Claims, 5 Drawing Sheets

MULTIPURPOSE BLOCK TOY

BACKGROUND OF THE INVENTION

The present invention relates to block toys and relates more particularly to a multipurpose block toy which can be used in playing the game of building, the game of domino effect, as well as the game of teaching and learning.

Conventionally, a block toy is consisted of a plurality of wooden or plastic bricks used in playing the game of building. Recently, there are several block toys disclosed for setting up into a variety of forms by means of tongue-and-groove and dowel joints. However, these blocks toys can only be built up into standing combinations and the parts of which can not be moved or rotated.

SUMMARY OF THE INVENTION

The present invention is provide a multipurpose block toy which is generally comprised of a set of blocks, a set of connecting rods and a set of rollers. The blocks each has a letter, character, mark or sign on the front face thereof, pin holes on the back face and the left-side edge thereof, a raised portion on the top edge thereof, pins on the raised portion and the right-side edge thereof, and an opening on the bottom edge thereof i a size fitting the raised portion. The connecting rods each has pins at two opposite ends, and pins and holes on the body thereof. The rollers each has holes on the front face thereof, and a revolving shaft through the central axis thereof, wherein the revolving shaft has a pin and a hole longitudinally aligned at two opposite ends. Either pin on either block, connecting rod or roller can be fitted into either hole on the other blocks, connecting rods or rollers. The blocks may be separately used in playing the game of domino effect or the game of teaching and learning, or simultaneously used with the connecting rods and the rollers in playing the game of building and the game of domino effect.

DETAILED DESCRIPTION OF THE PREFERRED EMBODIMENT

Figure 4:
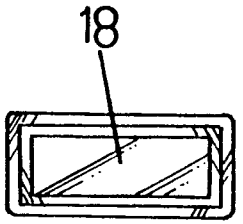
FIG. 4 is a bottom view of the block of FIG. 1.
Figure 3:
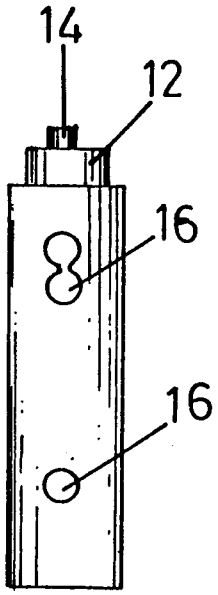
FIG. 3 is a left side view of the block of FIG. 1.
Figure 2:
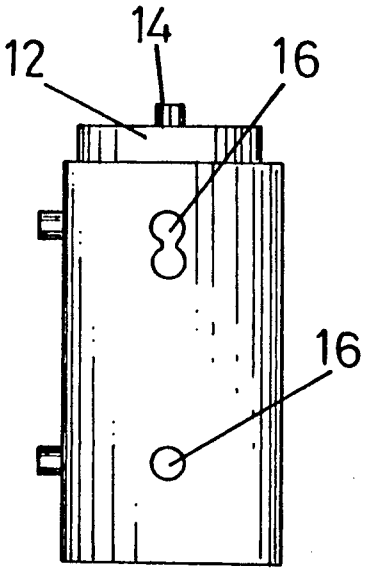
FIG. 2 is a rear view of the block of FIG. 1.
Figure 1:
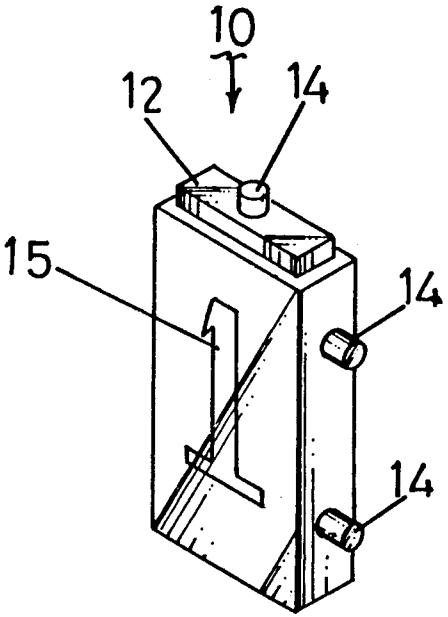
FIG. 1 is a perspective view of a block as constructed according to the present invention.

Turning now to the annexed drawings in detail and referring first to FIGS. 1 through 7, the present invention is generally comprised of three different sets of elements, namely, blocks 10, connecting rods 20, and rollers 30.

Referring to FIGS. 1 through 4, a block 10 is formed of a hollow quadratic prism having a raised portion 12 on the top edge thereof, a round pin 14 on the raised portion 12 at the middle, at least one round pin 14' projecting from the right-side edge thereof, at least one hole 16' on the left-side edge thereof corresponding to the at least one round pin 14' on the right-side edge thereof, at least one hole 16 on the back face thereof, a mark 15 made on the front face thereof, and an opening 18 on the bottom edge thereof. In the present preferred embodiment, the block has two round pins 14' on the right-side edge thereof, two holes 16' on the left-side edge thereof, and two holes 16 on the back face thereof. Each hole 16 or 16' can be simply formed of a round hole or two linked round holes. The raised portion 12 is made in such a size that tightly fits into the opening 18. The mark 15 on the front face of each block 10 can be a letter, a character, a pattern or a symbol made through the process of printing, cutting or injection molding.

Figure 5:
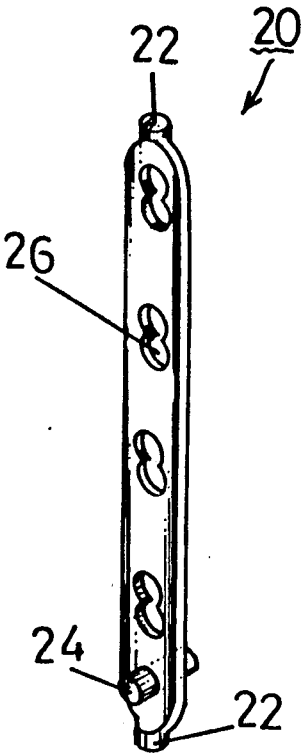
FIG. 5 is a perspective view of a connecting rod as constructed according to the present invention.

Referring to FIG. 5, a connecting rod 20 is made from an elongated flat rod having two round pins 22 longitudinally aligned at two opposite ends, at least one circular cross pin 24 at a suitable location, and at least one hole 26 on the body thereof. Each of the at least one hole 26 can be simply formed of a round hole or two linked round holes and respectively made in sizes equal to the holes 16, 16'. The round pins 22 and the at least one circular cross pin 24 have the same diameter equal to the round pins 14, 14' on each block 10.

Figure 7:
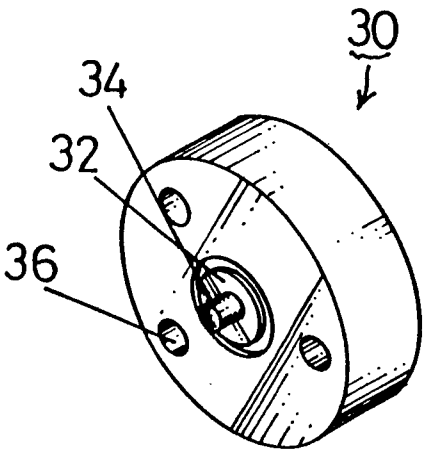
FIG. 7 is a perspective view of the roller of FIG. 6.
Figure 6:
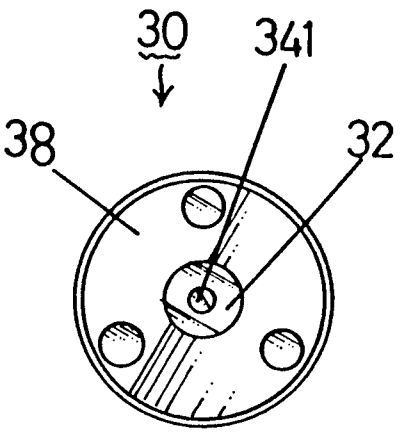
FIG. 6 is a bottom view of a roller as constructed according to the present invention.

Referring to FIGS. 6 and 7, a roller 30 has a shaft 32 at the center, which shaft 32 is rotatably mounted therein and has a unitary round pin 34 and a round hole 341 coaxially aligned at two opposite ends, at least one round hole 36 on the front face thereof, and a recessed 38 on the back face thereof. The round pin 34 has an outer diameter equal to the round pins 14, 14', 22 and the circular cross pin 24 that tightly fits into the at least one round hole 36, the holes 16, 16' and the at least one hole 26.

Figure 8:
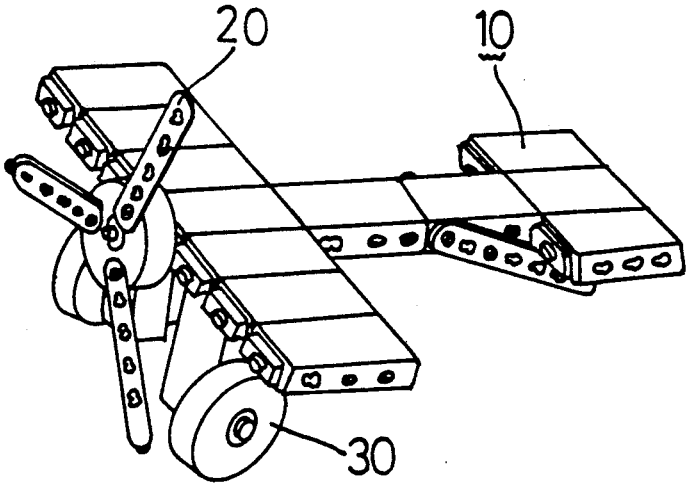
FIG. 8 illustrates a building example of a combination of airplane according to the present invention.
Figure 9:
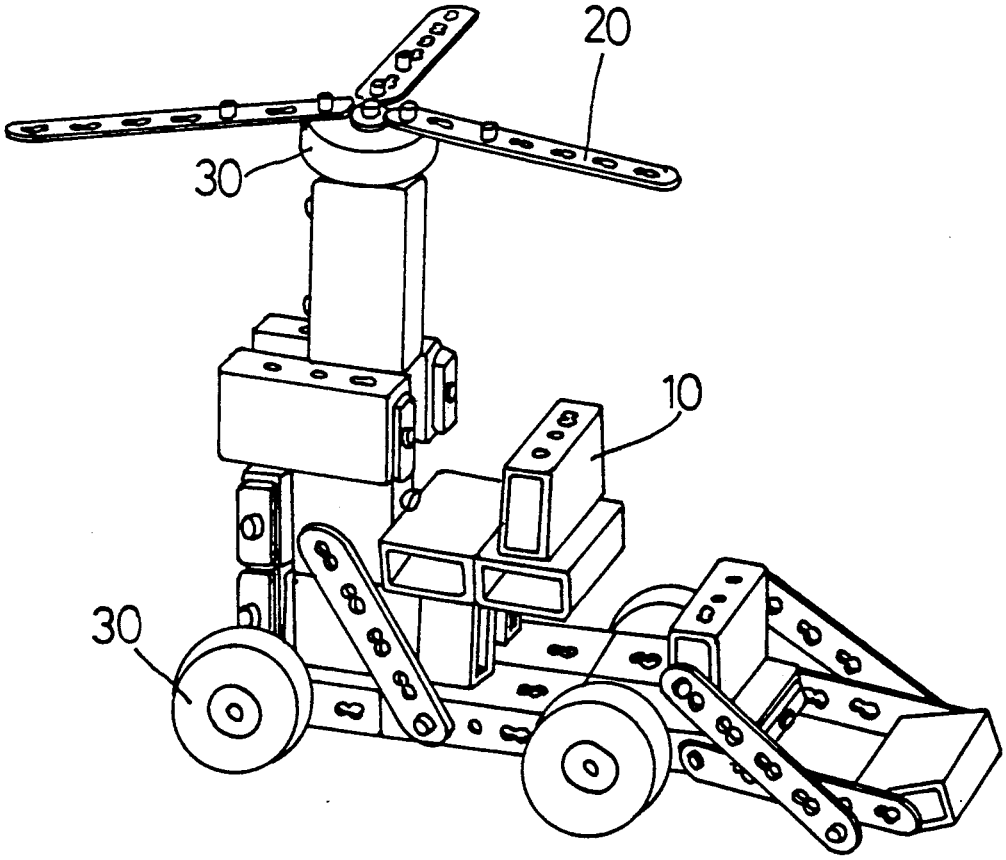
FIG. 9 illustrates another building example of a combination of space race car according to the present invention.
Figure 10:
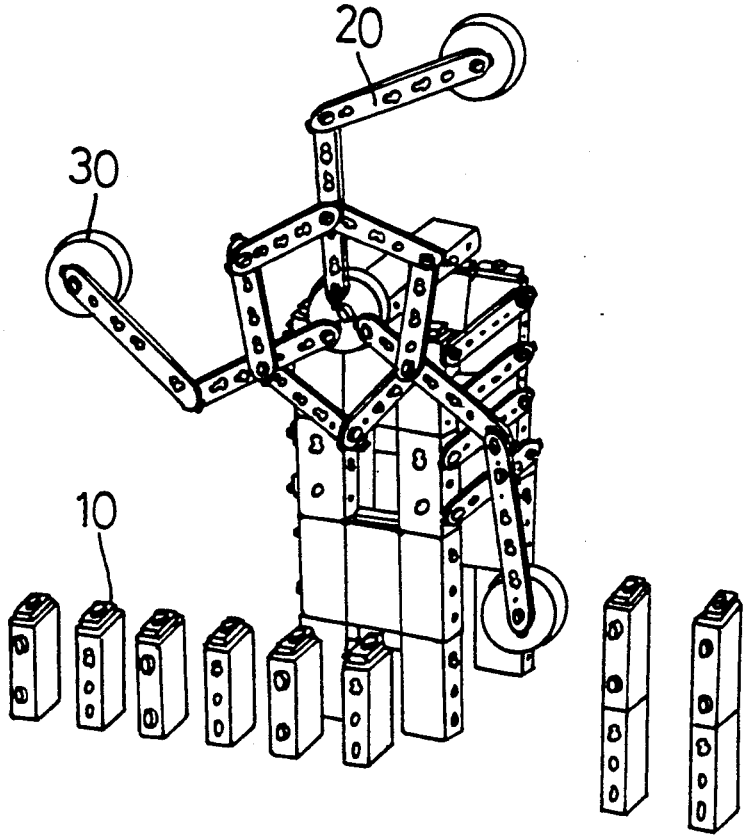
FIG. 10 illustrates still another building example of a combination of wind mill house according to the present invention.
Figure 11:
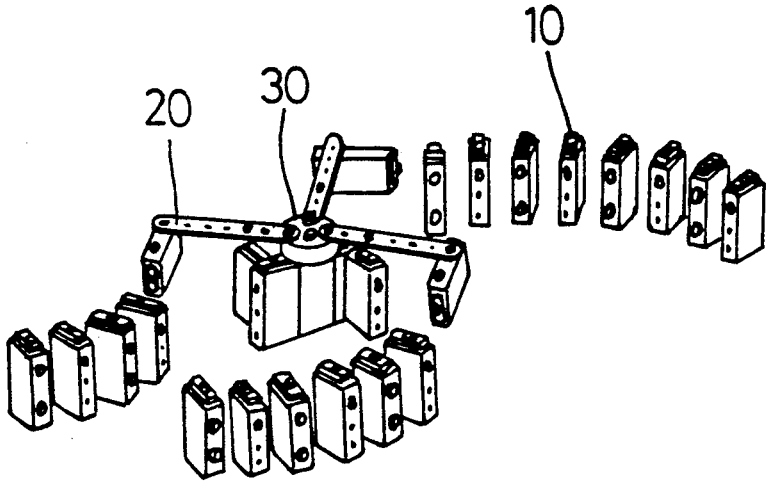
FIG. 11 illustrates still another building example of a combination of rotary chair and dominoes according to the present invention.
Figure 12:
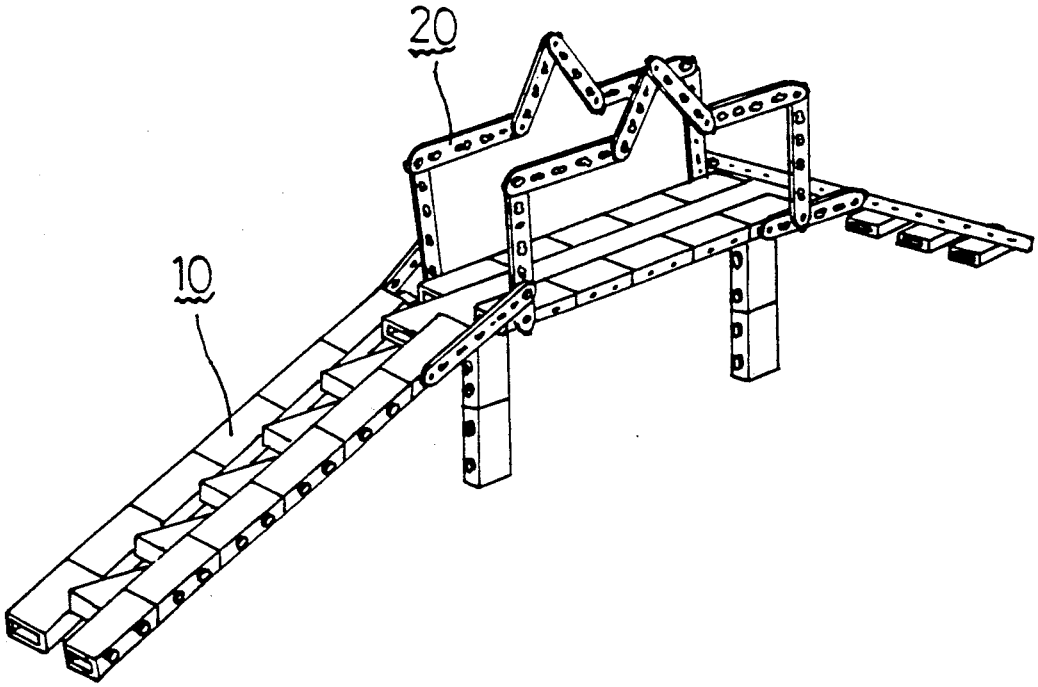
FIG. 12 illustrates still another building example of a combination of bridge according to the present invention.
Figure 13:
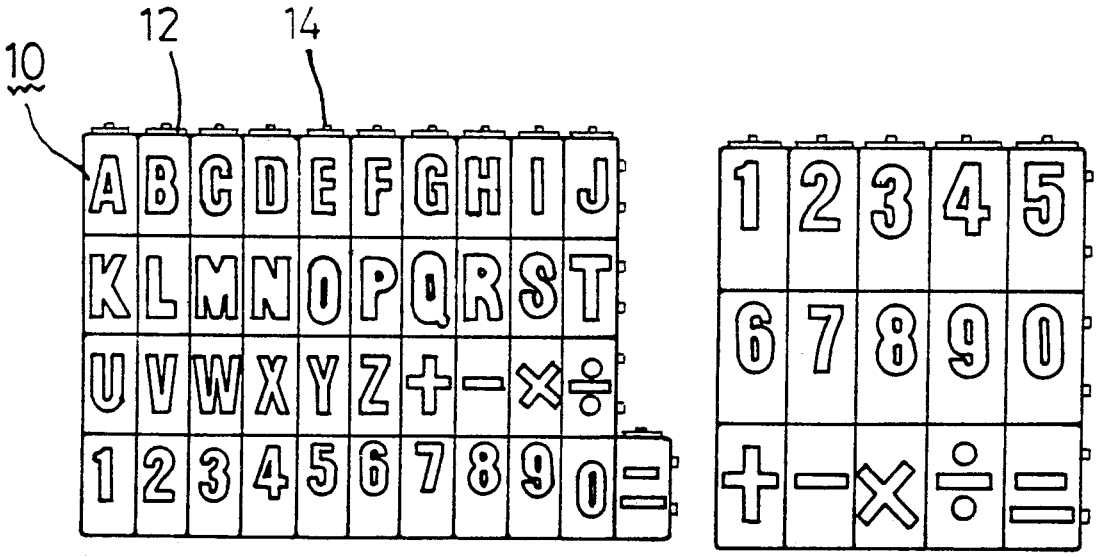
FIG. 13 is a plan combination set of English letters and Chinese phonetic characters according to the present invention.

A variety of combinations can be built up by using the aforesaid three different sets of elements. FIG. 8 illustrates a building example of a combination of airplane. FIG. 9 illustrates another building example of a combination of space race car. FIG. 10 illustrates still another building example of a combination of wind mill house. FIG. 11 illustrates still another building example of a combination of rotary chair and dominoes. FIG. 12 illustrates still another building example of a combination of bridge. In the combinations of FIGS. 10 and 11, several blocks 10 are arranged into several rows and used in playing the game of domino effect. Further, several blocks may be respectively marked with different marks so as to form into a set of English letters and Chinese phonetic characters, as shown in FIG. 13, for children to study and distinguish.

As indicated, the present invention is to provide a multipurpose block toy comprised of blocks, connecting rods and rollers that can be used in playing the game of building, the game of domino effect, and the game of teaching and learning.

What is claimed is:

1. A block toy, the improvement comprising:

a plurality of hollow quadratic blocks, said blocks each having a raised portion on a top edge thereof, a round pin on said raised portion at the middle, at least one round pin projecting from a right-side edge thereof, at least one pin hole on a left-side edge thereof, at least one pin hole on a back face thereof, indicia on a front face thereof, and an opening on a bottom edge thereof, said raised portion being made in a size tightly fitting into said opening;

a plurality of connecting rods, said connecting rods each having two round pins longitudinally aligned at two opposite ends, and at least one circular cross pin and at least one pin hole on the body thereof;

a plurality of rollers, said rollers each having a shaft rotatably mounted through the central axis thereof, said shaft having a unitary round pin and a pin hole co-axially aligned at opposite ends thereof, at least one pin hole on a front face thereof, and a recess on a back face thereof; and wherein said round pins and said at least one circular cross pin can be respectively alternatively fitted into said pin holes.

2. The block toy of claim 1, wherein said pin holes are respectively formed of a single round hole.

3. The block toy of claim 1, wherein said pin holes are respectively formed of two linked round holes.

* * * * *